US011819909B2

(12) United States Patent
Ito et al.

(10) Patent No.: US 11,819,909 B2
(45) Date of Patent: Nov. 21, 2023

(54) METHOD FOR MANUFACTURING HIGH-MANGANESE STEEL CAST SLAB AND METHOD FOR MANUFACTURING HIGH-MANGANESE STEEL SLAB OR STEEL SHEET

(71) Applicant: JFE Steel Corporation, Tokyo (JP)

(72) Inventors: Yoichi Ito, Tokyo (JP); Norichika Aramaki, Tokyo (JP); Koichi Nakashima, Tokyo (JP); Shigeki Kitsuya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 339 days.

(21) Appl. No.: 17/423,557

(22) PCT Filed: Jan. 22, 2020

(86) PCT No.: PCT/JP2020/002150
§ 371 (c)(1),
(2) Date: Jul. 16, 2021

(87) PCT Pub. No.: WO2020/153407
PCT Pub. Date: Jul. 30, 2020

(65) Prior Publication Data

US 2022/0118508 A1 Apr. 21, 2022

(30) Foreign Application Priority Data

Jan. 25, 2019 (JP) ..... 2019-011482

(51) Int. Cl.
*B22D 11/16* (2006.01)
*C21D 8/02* (2006.01)
(Continued)

(52) U.S. Cl.
CPC ..... *B22D 11/16* (2013.01); *C21D 8/0226* (2013.01); *C22C 38/02* (2013.01); *C22C 38/06* (2013.01); *C22C 38/58* (2013.01)

(58) Field of Classification Search
CPC ..... B22D 11/00; B22D 11/16; B22D 11/20; B21B 1/46
(Continued)

(56) References Cited

U.S. PATENT DOCUMENTS 5,123,969 A * 6/1992 Chou ..... C21D 8/0273 148/330
6,162,389 A * 12/2000 Hase et al. ..... C22C 38/04 420/92
(Continued)

FOREIGN PATENT DOCUMENTS

EP 700451 A1 3/1996
JP 5913556 A 1/1984
(Continued)

OTHER PUBLICATIONS

International Search Report and Written Opinion for International Application No. PCT/JP2020/002150, dated Apr. 14, 2020, 5 pages.
(Continued)

*Primary Examiner* — Kevin P Kerns
(74) *Attorney, Agent, or Firm* — RATNERPRESTIA

(57) ABSTRACT

The method for manufacturing a high-manganese steel cast slab according to the present invention includes manufacturing a cast slab by continuously casting a molten high-manganese steel having a specific chemical composition. In the manufacture, in a continuous-casting machine or during transportation before subsequent charging into a heating furnace for hot rolling, a processing strain is applied to the cast slab having a surface temperature of 600° C. or higher and 1100° C. or lower in such an amount that a processing
(Continued)

strain amount calculated by a certain formula is 3.0% or more and 10.0% or less.

4 Claims, 4 Drawing Sheets

(51) Int. Cl.
*C22C 38/02* (2006.01)
*C22C 38/06* (2006.01)
*C22C 38/58* (2006.01)

(58) Field of Classification Search
USPC ..... 164/451, 452, 476, 417; 29/527.7
See application file for complete search history.

(56) References Cited

U.S. PATENT DOCUMENTS

| | | | | |
|---|---|---|---|---|
| 2016/0010173 | A1* | 1/2016 | Scott et al. | C22C 38/002 148/505 |
| 2020/0232058 | A1 | 7/2020 | Takeda et al. | |
| 2021/0262049 | A1* | 8/2021 | Mizoguchi et al. | C22C 38/005 |

FOREIGN PATENT DOCUMENTS

| | | | |
|---|---|---|---|
| JP | 0657379 | A | 3/1994 |
| JP | 06322440 | A | 11/1994 |
| JP | 08507107 | A | 7/1996 |
| JP | 2011230182 | A | 11/2011 |
| JP | 2016196703 | A | 11/2016 |
| WO | 9526423 | A1 | 10/1995 |
| WO | 2018151318 | A1 | 8/2018 |

OTHER PUBLICATIONS

Extended European Search Report for European Application No. 20 744 915.8, dated Sep. 30, 2021, 7 pages.

Korean Office Action for Korean Application No. 10-2021-7021992, dated Feb. 1, 2023 with Concise Statement of Relevance of Office Action, 7 pages.

European Communication for European Application No. 20 744 915.8, dated Jun. 7, 2023, 6 pages.

* cited by examiner

METHOD FOR MANUFACTURING HIGH-MANGANESE STEEL CAST SLAB AND METHOD FOR MANUFACTURING HIGH-MANGANESE STEEL SLAB OR STEEL SHEET

CROSS REFERENCE TO RELATED APPLICATIONS

This is the U.S. National Phase application of PCT/2020/002150, filed Jan. 22, 2020, which claims priority to Japanese Patent Application No. 2019-011482, filed Jan. 25, 2019, the disclosures of these applications being incorporated herein by reference in their entireties for all purposes.

FIELD OF THE INVENTION

The present invention relates to a method for manufacturing a high-manganese steel cast slab used to manufacture a steel slab or steel sheet used as a high-manganese steel material for a machine structural component for a nuclear fusion facility, a roadbed for a linear motor car, a nuclear magnetic resonance tomography room, or the like or structural steel used in a cryogenic environment, such as a liquefied gas storage tank. The present invention also relates to a method for manufacturing a high-manganese steel slab or steel sheet by using the high-manganese steel cast slab.

BACKGROUND OF THE INVENTION

High-manganese steel, which has an austenite single-phase microstructure and non-magnetic properties, has been increasingly needed as an alternative inexpensive steel material to conventional cryogenic metal materials such as austenitic stainless steel, 9% nickel steel, and 5000 series aluminum alloys.

Conventionally, a steel slab used as a material for such high-manganese steel has been typically manufactured by producing a steel ingot by ingot casting and hot-blooming the steel ingot, but in recent years, manufacturing from a cast slab produced by continuous casting has become essential from the viewpoint of productivity improvement and cost reduction. When a high-manganese steel slab is manufactured from a cast slab produced by continuous casting, surface cracking of the cast slab during continuous casting and surface cracking of the steel slab during blooming frequently occur, leading to problems of increase in repairs for removing crack flaws and reduction in yield. Thus, there has been a strong need for a method for manufacturing a high-manganese steel slab from a continuously cast slab that can suppress surface cracking of the cast slab and the steel slab.

A technique for hot rolling a continuously cast slab of high-manganese steel without causing surface cracking is disclosed in Patent Literature 1. This technique is a method in which in continuous casting of a molten steel containing, by mass %, C: 0.2% to 0.8%, Si: 0.5% or less, Mn: 11% to 20%, and Cr: 3% or less, the lower limit of a cooling final temperature of the surface of a cast slab is set to be not less than a value calculated using functions of contents of C and Cr, while the cast slab is charged into a heating furnace while maintaining its surface temperature at a temperature not less than the cooling final temperature, and a rolling strain applied in a first pass in hot rolling is in the range of 3% to 6%.

Patent Literature 2 discloses a method in which in continuous casting of a molten steel containing, by mass %, C: 0.9% to 1.20%, Mn: 11.0% to 14.0%, and P: 0.08% or less, the specific water volume of secondary cooling water is set to be in the range of 0.7 to 1.1 L/kg, and the cast slab is further soaked and then pre-rolled under regulated heating and temperature holding conditions in a soaking furnace, while water toughening is performed after the pre-rolling, whereby surface cracking is prevented.

Patent Literature 3 discloses a method for manufacturing a high-manganese steel. In this method, in continuous casting of a molten steel containing, by mass %, C: 0.09% to 1.5%, Si: 0.05% to 1.0%, Mn: 10% to 31%, P: 0.05% or less, S: 0.02% or less, Cr: 10% or less, Al: 0.003% to 0.1%, and N: 0.005% to 0.50%, with the balance being Fe and impurities, the molten steel temperature immediately before supply to a mold and the casting speed are set to be within moderate ranges, whereby the occurrence of defects such as surface cracking is suppressed. Patent Literature 4 discloses, as a cryogenic high-manganese steel material including a tough base metal and a tough welded heat affected zone, a high-manganese steel having a chemical composition in a suitable range in which, for example, Mg, Ca, and REM are added.

CITATION LIST

Patent Literature

PTL 1: Japanese Unexamined Patent Application Publication No. 6-322440

PTL 2: Japanese Unexamined Patent Application Publication No. 59-13556

PTL 3: Japanese Unexamined Patent Application Publication No. 2011-230182

PTL 4: Japanese Unexamined Patent Application Publication No. 2016-196703

SUMMARY OF THE INVENTION

In the methods disclosed in Patent Literatures 1 and 2, temperature holding and soaking treatment of a cast slab after continuous casting are essential, which imposes significant limitations on the manufacturing process. In particular, it is practically difficult to strictly control the temperature of the cast slab during the transport thereof. Thus, a sufficient surface cracking suppression effect is not produced in the case of a cast slab having a chemical composition containing a Mn content of 20 mass % or more or a Cr content of more than 3%.

The method disclosed in Patent Literature 3 is intended to solve the unevenness of an initial solidified shell in a mold or avoid grain boundary embrittlement due to melting of a low-melting carbide formed at a grain boundary, and is directed at cracking of a cast slab in a relatively high temperature range. On the other hand, phenomena in lower temperature ranges have great influences on surface cracking of high-manganese steel as described below, and thus the method disclosed in Patent Literature 3 cannot sufficiently suppress surface cracking of high-manganese steel. Patent Literature 4 only discloses, as a cryogenic high-manganese steel material, a chemical composition in a suitable range in which, for example, Mg, Ca, and REM are added and does not describe conditions under which a molten steel having the chemical composition is continuously cast without causing defects such as surface cracking.

Aspects of the present invention have been made in view of such circumstances, and an object according to aspects of the present invention is to provide a method for manufacturing a high-manganese steel cast slab that can suppress cracking during rolling even when a high-manganese steel slab or steel sheet having a Mn content of more than 20 mass % is manufactured. Another object according to aspects of the present invention is to provide a method for manufacturing a high-manganese steel slab or steel sheet by using the high-manganese steel cast slab. In accordance with aspects of the present invention, the term "cast slab" refers to those which have not yet been subjected to subsequent hot rolling, and those which have been subjected to, for example, the application of a processing strain in accordance with aspects of the present invention or surface repairs before being subjected to hot rolling are also referred to as cast slabs.

The gist of aspects of the present invention for solving the foregoing problems is as follows.

[1] A method for manufacturing a high-manganese steel cast slab includes manufacturing a cast slab by continuously casting a molten steel having a chemical composition containing, by mass %, C: 0.10% or more and 1.3% or less, Si: 0.10% or more and 0.90% or less, Mn: 10% or more and 30% or less, P: 0.030% or less, S: 0.0070% or less, Al: 0.01% or more and 0.07% or less, Cr: 0.1% or more and 10% or less, Ni: 0.01% or more and 1.0% or less, Ca: 0.0001% or more and 0.010% or less, and N: 0.0050% or more and 0.2000% or less, and further containing, as optional additive elements, Mg: 0.0001% or more and 0.010% or less and REM: 0.0001% or more and 0.010% or less, with the balance being iron and unavoidable impurities. In the manufacture, in a continuous-casting machine or during transportation before subsequent charging into a heating furnace for hot rolling, a processing strain is applied to the cast slab having a surface temperature of 600° C. or higher and 1100° C. or lower in such an amount that a processing strain amount calculated by formula (1) below is 3.0% or more and 10.0% or less.

$$\text{Processing strain amount (\%)} = \ln(\text{sectional area of cast slab before processing}/\text{sectional area of cast slab after processing}) \times 100 \quad (1)$$

[2] In the method for manufacturing a high-manganese steel cast slab according to [1], the processing strain is applied to the cast slab having a surface temperature equal to or higher than Tp calculated by formula (2) below.

$$Tp(^\circ\text{ C.}) = 600 + 15[\%\text{ C}]^2 + 333[\%\text{ C}] - 4[\%\text{ Mn}] + 40[\%\text{ Cr}] \quad (2)$$

In formula (2), [% C], [% Mn], and [% Cr] are contents (mass %) of C, Mn, and Cr, respectively, in the cast slab.

[3] In the method for manufacturing a high-manganese steel cast slab according to [1] or [2], the chemical composition of the cast slab further satisfies formula (3) below.

$$[\%\text{ Mn}] \times ([\%\text{ S}] - 0.8 \times [\%\text{ Ca}]) \leq 0.10 \quad (3)$$

In formula (3), [% Mn], [% S], and [% Ca] are contents (mass %) of Mn, S, and Ca, respectively, in the cast slab.

[4] A method for manufacturing a high-manganese steel slab or steel sheet includes hot rolling a cast slab manufactured by the method for manufacturing a high-manganese steel cast slab according to any one of [1] to [3].

By using a cast slab manufactured by the method for manufacturing a high-manganese steel cast slab according to aspects of the present invention, surface cracking during hot rolling is suppressed, and a high-manganese steel cast slab with suppressed surface cracking can be manufactured. This can achieve a reduction in repair cost, a reduction in manufacturing lead time, and an improvement in yield in manufacturing a high-manganese steel slab or steel sheet.

DETAILED DESCRIPTION OF EMBODIMENTS OF THE INVENTION

Figure 1:
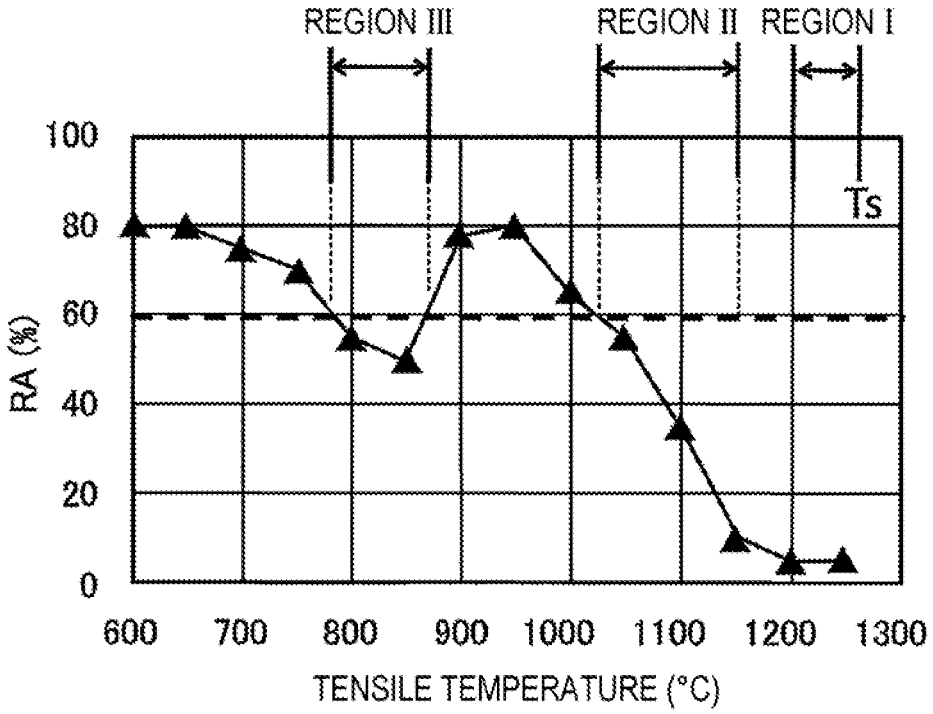
FIG. 1 is a graph showing the relationship between RA values obtained in a high-temperature tensile test and tensile temperatures.

Hereinafter, an embodiment of the present invention will be described. Aspects of the present invention is not limited to the following embodiment. A high-manganese steel according to this embodiment has a chemical composition containing C: 0.10% or more and 1.3% or less, Si: 0.10% or more and 0.90% or less, Mn: 10% or more and 30% or less, P: 0.030% or less, S: 0.0070% or less, Al: 0.01% or more and 0.07% or less, Cr: 10% or less, Ni: 0.01% or more and 1.0% or less, Ca: 0.0001% or more and 0.010% or less, and N: 0.0050% or more and 0.2000% or less, with the balance being iron and unavoidable impurities. In the chemical composition, "%" that denotes a content of a component means "mass %" unless otherwise specified.

C (Carbon): 0.10% or More and 1.3% or Less

C is added for the purpose of stabilization of an austenite phase and improvement in strength. If the C content is less than 0.10%, necessary strength cannot be obtained. On the other hand, if the C content is more than 1.3%, excessive amounts of carbide and cementite precipitate to reduce toughness. Thus, the C content needs to be 0.10% or more and 1.3% or less and is preferably 0.30% or more and 0.8% or less.

Si (Silicon): 0.10% or More and 0.90% or Less

Si is added for the purpose of deoxidization and solid solution strengthening. To produce this effect, the Si content needs to be 0.10% or more. On the other hand, Si is a ferrite stabilizing element, and if Si is added in a large amount, an austenite microstructure of the high-manganese steel becomes unstable. Thus, the Si content needs to be 0.90% or less. Therefore, the Si content needs to be 0.10% or more and 0.90% or less and is preferably 0.20% or more and 0.60% or less.

Mn (Manganese): 10% or More and 30% or Less

Mn is an element that stabilizes the austenite microstructure and provides an increase in strength. In particular, a Mn content of 10% or more provides properties that austenite steel is expected to have, such as non-magnetic properties and low-temperature toughness. On the other hand, austenite steel is generally poor in hot workability, and, in particular, high-manganese steel is known as a material highly susceptible to cracking during continuous casting or hot rolling. In particular, a Mn content of more than 30% significantly reduces workability. Thus, the Mn content needs to be 10% or more and 30% or less and is preferably 20% or more and 28% or less.

P (Phosphorus): 0.030% or Less

P is an impurity element contained in the steel and causes a reduction in toughness and hot embrittlement. Thus, the P content is preferably as low as possible but may be up to 0.030%. Therefore, the P content needs to be 0.030% or less and is preferably 0.015% or less.

S (Sulfur): 0.0070% or Less

S is an impurity element contained in the steel and reduces toughness starting from a sulfide such as MnS. Thus, the S content is preferably as low as possible but may be up to 0.0070%. Therefore, the S content needs to be 0.0070% or less and is preferably 0.0030% or less.

Al (Aluminum): 0.01% or More and 0.07% or Less

Al is added for the purpose of deoxidization. To produce a necessary deoxidization effect, the Al content needs to be 0.01% or more. On the other hand, if Al is added such that the Al content exceeds 0.07%, the deoxidization effect peaks out, and at the same time, an excessive amount of AlN is formed to reduce hot workability. Thus, the Al content needs to be 0.01% or more and 0.07% or less and is preferably 0.02% or more and 0.05% or less.

Cr (Chromium): 0.1% or More and 10% or Less

Cr is added for the purpose of solid solution strengthening. Thus, the Cr content needs to be 0.1% or more. On the other hand, if Cr is added in a large amount, the austenite microstructure of the high-manganese steel becomes unstable, and a coarse carbide, which can cause embrittlement, precipitates. Thus, the Cr content needs to be 10% or less and is preferably 7% or less.

Ni (Nickel): 0.01% or More and 1.0% or Less

Ni is an element that stabilizes the austenite microstructure and contributes to inhibition of carbide precipitation. Thus, the Ni content needs to be 0.01% or more. On the other hand, if Ni is excessively added, martensite is readily formed, and thus the Ni content needs to be 1.0% or less and is preferably 0.02% or more and 0.8% or less.

Ca (Calcium): 0.0001% or More and 0.010% or Less

Ca, if added in an appropriate amount, forms fine oxides and sulfides and suppresses grain boundary embrittlement due to precipitated inclusions. Thus, the Ca content needs to be 0.0001% or more. On the other hand, if the Ca content is excessive, precipitated inclusions are coarsened to rather promote grain boundary embrittlement. Thus, the Ca content needs to be 0.010% or less. The Ca content is preferably 0.0005% or more and 0.0050% or less.

N (Nitrogen): 0.0050% or More and 0.2000% or Less

N stabilizes the austenite microstructure and increases strength through solid dissolution and precipitation. To achieve this effect, the N content needs to be 0.0050% or more. On the other hand, a N content of more than 0.2000% reduces hot workability. Thus, the N content needs to be 0.0050% or more and 0.2000 or less, and the N content is preferably 0.0050% or more and 0.1000% or less.

Optionally, Mg (magnesium) and REM may be contained. Mg and REM each produce the same effect as produced by Ca, and thus the contents thereof may each be 0.0001% or more and 0.010% or less. The balance is iron and unavoidable impurities. Here, REM is a general term applied to a total of 17 elements including 15 elements from La (lanthanum, atomic number: 57) to Lu (lutetium, atomic number: 71), Sc (scandium, atomic number: 21), and Y (yttrium, atomic number: 39).

Next, a high-temperature tensile test that assumes a mechanism by which cracking occurs during hot rolling of a high-manganese steel having the above chemical composition will be described. As a typical high-manganese steel, a molten steel having a chemical composition shown in Table 1 was prepared on laboratory scale and then formed into a steel ingot. A test piece was taken from the steel ingot, and a high-temperature tensile test was performed.

TABLE 1

| | Chemical element | | | | | | |
|---|---|---|---|---|---|---|---|
| | C | Si | Mn | P | S | Cr | Al |
| Chemical composition | 0.5 | 0.5 | 25 | 0.025 | 0.007 | 7 | 0.025 |

Unit: mass %

FIG. 1 is a graph showing the relationship between RA (drawing) values obtained in the high-temperature tensile test and tensile temperatures. The RA values on the vertical axis in FIG. 1 were determined by formula (4) below.

$$RA\ (\%)=(\text{test piece sectional area before testing}-\text{test piece sectional area after testing (after fracture)})/(\text{test piece sectional area before testing})\times 100 \quad (4)$$

In the case of a steel having a manganese concentration of lower than 10 mass %, the RA value at which cracking probably does not occur in a steel slab during hot rolling is 60% or more. However, it was shown that in the case of a high-manganese steel having a manganese concentration of 10 mass % or more, there are temperature ranges where cracking occurs in a steel slab even if the RA value is 60% or more, as shown in FIG. 1. From this result and the results of observations of a test piece fracture surface after high-temperature tensile testing under a light microscope and a scanning electron microscope (SEM), the cause of cracking of the high-manganese steel was presumed with a temperature range where the RA value decreased being divided into the following region I, region II, and region III.

The region I is a temperature range where the RA value is low from a solidus temperature TS to 1200° C. This cracking results from a local decrease in melting point at a grain boundary due to segregation concentration of, for example, C, P, or S at the grain boundary, and is known as a liquid membrane embrittlement phenomenon that occurs when the temperature of a cast slab is decreased below the solidus temperature during casting. The measures against this cracking are the same as the commonly well-known measures to prevent internal cracking in continuous casting. Specifically, continuous casting is performed at a low casting speed to suppress bulging of the cast slab at the nip between rolls.

The region II is a temperature range where the RA value is low from 1150° C. to 1030° C. This cracking results from an embrittlement phenomenon due to concentration of S at a grain boundary and precipitation of a sulfide such as MnS. In particular, high-manganese steel undergoes austenite solidification and does not undergo phase transformation in the subsequent cooling process, and thus grain boundary embrittlement due to sulfide formation readily occurs. The strength of a grain boundary is influenced by the S content and the amount of precipitation of MnS, and thus it is important for the prevention of cracking to control the amount of MnS precipitation at the grain boundary to be at or lower than an embrittlement tolerance.

The region III is a temperature range where the RA value is low from 860° C. to 780° C. This cracking results from an embrittlement phenomenon due to precipitation of mainly a $M_{23}C_6$ carbide at a grain boundary of coarse grains. As described above, high-manganese steel undergoes austenite solidification and does not undergo phase transformation in the subsequent cooling process, and thus coarse grains formed in the stage of casting remain present until the subsequent hot rolling step. A carbide preferentially precipitates at a grain boundary, and when grains are coarse, the carbide that precipitates at the grain boundary also tends to be coarse. The coarse carbide, if reheated before hot rolling, is not completely dissolved in steel and remains at the grain boundary in many cases. Thus, even if a cast slab is not cracked during continuous casting, cracking may occur in a steel slab obtained by hot rolling. Therefore, it is important for the suppression of cracking to take measures to prevent coarsening of grains at the stage of casting.

From the above discussion, it was presumed that surface cracking of the high-manganese steel in the region II and the region III is mainly due to the sulfide and the coarse carbide precipitated at grain boundaries. That is to say, it was determined that the reason why high-manganese steel is more susceptible to cracking than other types of steel is that high-manganese steel is composed of an austenite single-phase steel or austenite single phase+ferrite microstructure, and the grain size in a region extending from the surface layer of a cast slab to a position at 10 mm in the thickness direction of the cast slab is 2 to 5 mm, which is much coarser than the prior-austenite grain size of plain steel, i.e., 0.5 to 1.5 mm.

As a method of suppressing coarsening of grains in a cast slab, application of a processing strain to a high-manganese steel at high temperature was studied. Changes in grain size that occurred when a predetermined amount of processing strain was applied at a strain rate of $10^{-2}$ (1/s) were investigated with the temperature of test pieces taken from a laboratory-scale steel ingot set to 600° C. to 1200° C. The investigation of the changes in grain size was performed by microscopically observing the test pieces after testing. The temperature of the test pieces is the surface temperature of the test pieces.

Figure 2:
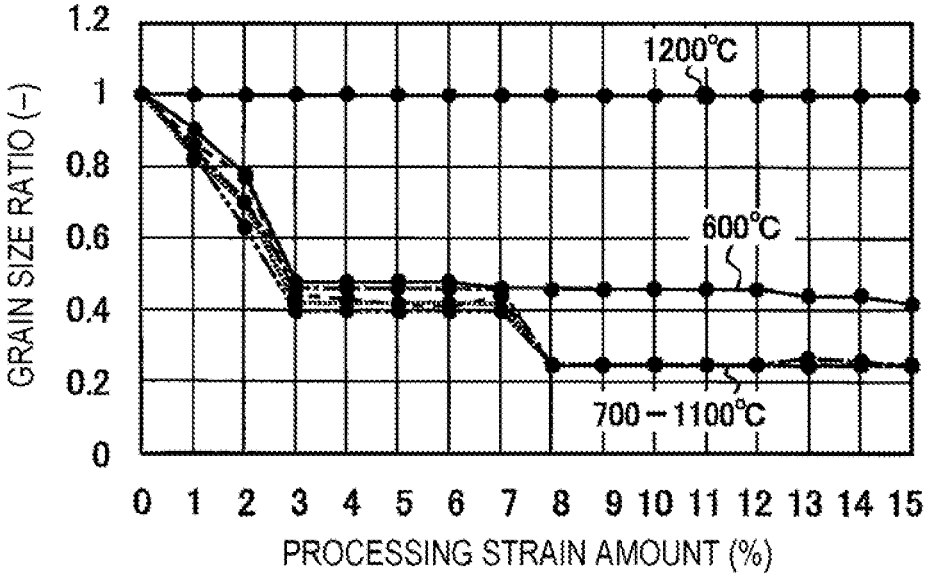
FIG. 2 is a graph showing the relationship between grain size ratios and processing strain amounts.

FIG. 2 is a graph showing the relationship between grain size ratios and processing strain amounts. In FIG. 2, the vertical axis represents the grain size ratios (–), which are values calculated by formula (5) below, and the horizontal axis represents the processing strain amounts (%), which are values calculated by formula (6) below. The symbol (–) indicates being non-dimensional.

$$\text{Grain size ratio}(-) = \text{grain size after strain processing}/\text{initial grain size} \quad (5)$$

$$\text{Processing strain amount}(\%) = \ln(\text{sectional area of test piece before processing}/\text{sectional area of test piece after processing}) \times 100 \quad (6)$$

As shown in FIG. 2, it was confirmed that the grain size can be reduced to ½ or less by applying a processing strain of 3.0% or more in the temperature range of 600° C. to 1100° C. This result probably indicates that dynamic recrystallization proceeded upon the application of a strain at high temperature, and austenite grains were refined.

In a manufacturing process, by applying a processing strain at any time point from inside a continuous-casting machine until hot rolling under conditions that enable the above grain refining, grains in a cast slab surface layer can be refined, thus enabling the manufacture of a cast slab that can suppress surface cracking during hot rolling.

The process of applying a processing strain may be performed, similarly to general hot rolling, by pressing the cast slab with one or more pairs of reduction rolls in the continuous-casting machine or after the continuous-casting machine. The strain rate at which a processing strain is applied may be any rate in the range of $10^{-2}$ (1/s) or more and less than 5 (1/s). The amount of processing strain applied needs to be such that the processing strain amount calculated by formula (1) below is 3.0% or more. As shown in FIG. 2, the temperature range where a processing strain is applied needs to be 600° C. or higher and 1100° C. or lower.

$$\text{Processing strain amount}(\%) = \ln(\text{sectional area of cast slab before processing}/\text{sectional area of cast slab after processing}) \times 100 \quad (1)$$

In formula (1) above, "sectional area of cast slab before processing" is an area of a section of a cast slab before application of a processing strain, the section being perpendicular to a casting direction (the direction of travel of the cast slab), and "sectional area of cast slab after processing" is an area of a section of the cast slab after the application of a processing strain, the section being perpendicular to the casting direction (the direction of travel of the cast slab).

However, if the processing strain is excessively applied, internal cracking of the cast slab may occur, or a coarse grain boundary may fracture to promote cracking, and thus the amount of processing strain applied is set to 10.0% or less.

On the assumption of a method in which a processing strain is applied to a cast slab of high-manganese steel by pressing it in a continuous-casting machine or before hot rolling after the continuous-casting machine, further desirable conditions were studied in order to reduce the possibility that cracking is caused by the application of a processing strain.

In the temperature range of the region III, in addition to coarse grains, the formation of a very large carbide at a grain boundary may also cause embrittlement of high-manganese steel, as described above. Therefore, if a very large carbide is precipitated at a grain boundary before the application of a processing strain for making the grain size fine, it may be impossible to obtain the cracking suppression effect produced by processing strain application.

The carbide in question here is a $M_{23}C_6$ carbide, which is typically composed of elements of Mn, Cr, Fe, and Mo, and its precipitation temperature greatly varies depending on the composition of the carbide. Of these elements, Cr effectively increases the precipitation temperature of the carbide as the content thereof increases. In the case of a high-Cr composition, particular care should be taken because the $M_{23}C_6$ carbide precipitates at a high temperature exceeding 800° C.

For high-manganese steels having various chemical compositions, the relationship between the composition and precipitation temperature of carbides was investigated by the following method. First, laboratory-scale steel ingots of various high-manganese steels with varied chemical compositions were each prepared and transported out of a continuous-casting machine or a heating furnace. Each steel ingot was cooled at a cooling rate near the rate during hot rolling, and then quenched after a predetermined temperature was reached, whereby the microstructure was frozen to prepare a sample for observation. The sample for observation was subjected to residue extractive analysis and scanning electron microscope (SEM) observation to determine the carbide composition of the sample, and the relationship between the carbide composition and the quenching temperature was investigated to determine whether the precipitation temperature Tp of the carbide can be expressed by a regression equation with the contents of C, Mn, and Cr as variables.

Figure 3:
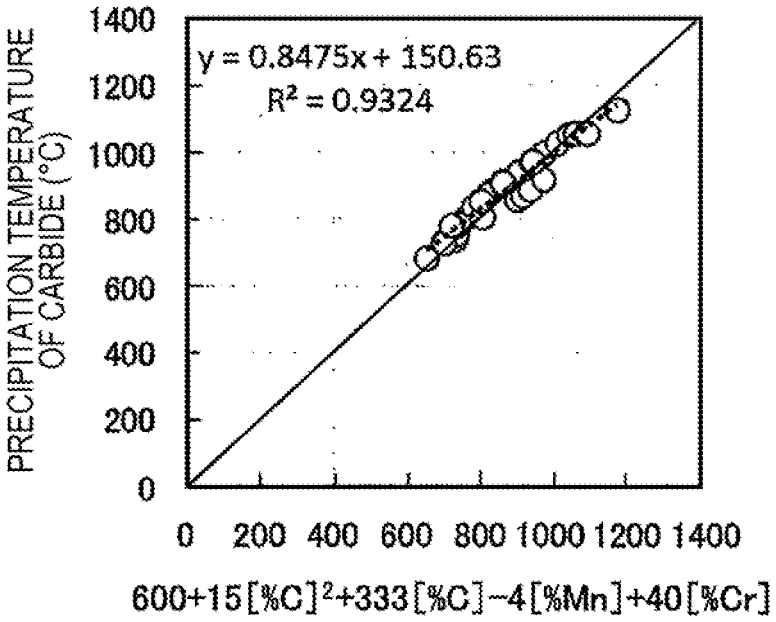
FIG. 3 is a graph showing the relationship between the precipitation temperature of carbides and $600+15[\%\text{ C}]^2+333[\%\text{ C}]-4[\%\text{ Mn}]+40[\%\text{ Cr}]$.

FIG. 3 is a graph showing the relationship between the precipitation temperature of carbides and $600+15[\%\ C]^2+333[\%\ C]-4[\%\ Mn]+40[\%\ Cr]$. In FIG. 3, the vertical axis represents measured values of the precipitation temperature (° C.) of the carbides, and the horizontal axis represents values calculated by $600+15[\%\ C]^2+333[\%\ C]-4[\%\ Mn]+40[\%\ Cr]$.

As shown in FIG. 3, the precipitation temperature Tp (° C.) of $M_{23}C_6$ carbides was organized well with a regression equation with the contents of C, Mn, and Cr as variables. Thus, for the temperature at which a processing strain is applied, it can be preferable to apply the processing strain to a cast slab whose surface temperature is equal to or higher than Tp, which is a precipitation temperature of a carbide, that is, a cast slab whose surface temperature is equal to or higher than Tp calculated by formula (2) below.

$$Tp(^\circ\ C.) = 600 + 15[\%\ C]^2 + 333[\%\ C] - 4[\%\ Mn] + 40[\%\ Cr] \quad (2)$$

In formula (2) above, [% C], [% Mn], and [% Cr] are contents (mass %) of C, Mn, and Cr, respectively, in a chemical composition of a cast slab.

To more effectively suppress cracking in the temperature range of the above region II of a cast slab of high-manganese steel, conditions that reduce the amount of precipitation of MnS, which can cause cracking, were investigated. Laboratory-scale steel ingots of various high-manganese steels with varied chemical compositions of Mn, S, and Ca were prepared, and a high-temperature tensile test was performed using test pieces taken from the steel ingots. The test was performed under test conditions of test temperatures of 600° C. to 1250° C. and a strain rate of $3.5\times10^{-4}$ (1/s), and RA values of fractured test pieces were determined. As a result, test pieces with Ca added had improved RA values, which showed that the addition of Ca was effective in fixing dissolved S and suppressing concentrated precipitation of MnS at a grain boundary.

Figure 4:
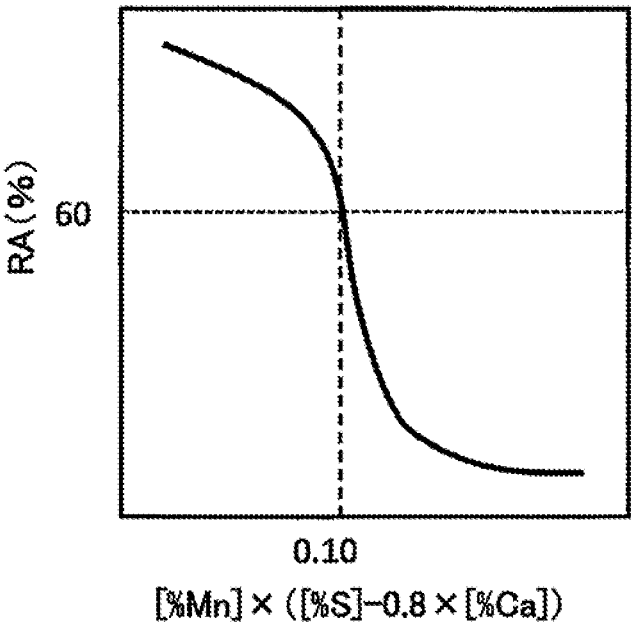
FIG. 4 is a graph showing the relationship between RA values and $[\%\text{ Mn}]\times([\%\text{ S}]-0.8\times[\%\text{ Ca}])$.

FIG. 4 is a graph showing the relationship between RA values and $[\%\ Mn]\times([\%\ S]-0.8\times[\%\ Ca])$. In FIG. 4, the RA values are values calculated from formula (4) mentioned above. As shown in FIG. 4, the RA values have the relationship shown in FIG. 4 with respect to solubility products of Mn and S with the addition of Ca taken into account, which shows that surface cracking in the region II can be suppressed when the chemical composition satisfies formula (3) below.

$$[\%\ Mn]\times([\%\ S]-0.8\times[\%\ Ca]) \leq 0.10 \quad (3)$$

In formula (3) above, [% Mn], [% S], and [% Ca] are contents (mass %) of Mn, S, and Ca, respectively, in a chemical composition of a cast slab.

As described above, when the chemical composition of a cast slab satisfies formula (3) above, the grain boundary strength is improved by the addition of Ca and a lowered S content, and surface cracking at or near 1000° C. (region II) during continuous casting and hot rolling is suppressed.

Figure 5:
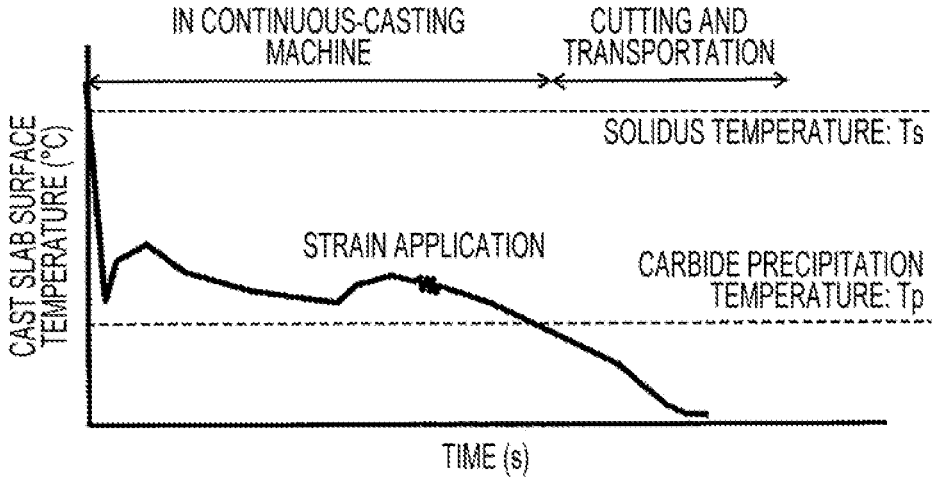
FIG. 5 is a graph showing how the surface temperature of a cast slab changes when a processing strain of 8.0% is applied to the cast slab in a horizontal zone in a continuous-casting machine.

FIG. 5 is a graph showing how the surface temperature of a cast slab changes when a processing strain of 8.0% is applied to the cast slab in a horizontal zone in a continuous-casting machine. In FIG. 5, the vertical axis represents the surface temperature (° C.) of the cast slab, and the horizontal axis represents time (s). As shown in FIG. 5, a processing strain of 8% was applied to a cast slab whose surface temperature was equal to or higher than Tp. The cast slab to which a processing strain was applied in the above manner was quenched to cause microstructure freezing, and a solidified microstructure in the vicinity of the surface was observed. In the example shown in FIG. 5, Tp is 864° C., and the temperature at which the processing strain was applied is 925° C.

Figure 6:
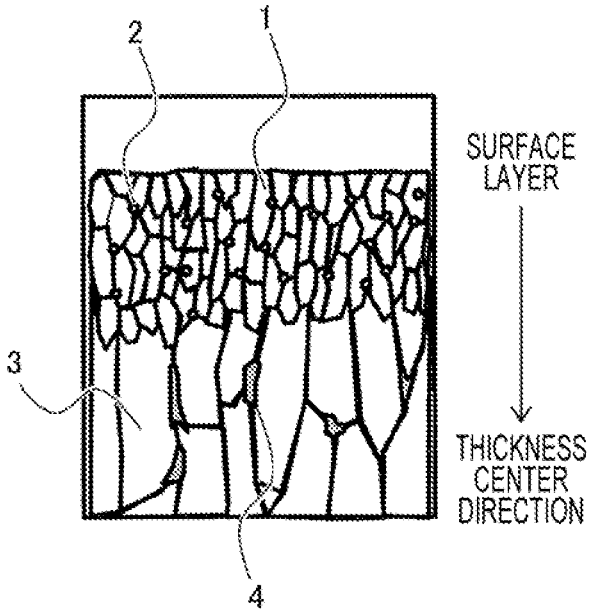
FIG. 6 schematically illustrates a solidified microstructure in the vicinity of the surface of a cast slab whose surface temperature is equal to or higher than Tp and to which a processing strain of 8.0% has been applied.

FIG. 6 schematically illustrates a solidified microstructure in the vicinity of the surface of a cast slab whose surface temperature is equal to or higher than Tp and to which a processing strain of 8.0% has been applied. As illustrated in FIG. 6, it was confirmed that by applying a processing strain of 8% in the horizontal zone in the continuous-casting machine, fine austenite grains 1 having a grain size of about 0.5 mm and fine carbides ($M_{23}C_6$) 2 were formed in a region extending from the surface layer of the cast slab to a depth of about 5 mm, and coarse austenite columnar crystals 3 and coarse carbides ($M_{23}C_6$) 4 were absent in the region.

Figure 7:
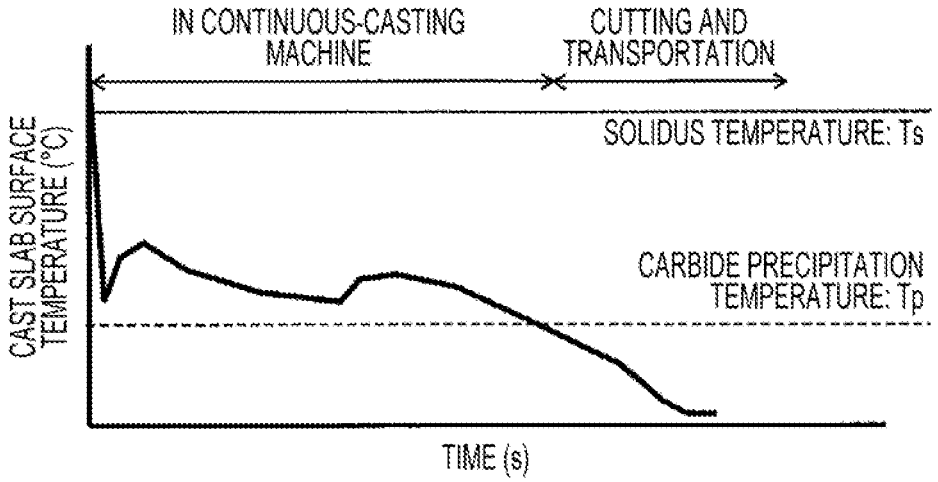
FIG. 7 is a graph showing how the surface temperature of a cast slab changes when a processing strain of 8.0% is not applied to the cast slab in a horizontal zone in a continuous-casting machine.

FIG. 7 is a graph showing how the surface temperature of a cast slab changes when a processing strain of 8.0% is not applied to the cast slab in a horizontal zone in a continuous-casting machine. In FIG. 7, the vertical axis represents the surface temperature (° C.) of the cast slab, and the horizontal axis represents time (s). The cast slab cast under the conditions shown in FIG. 7 was quenched to cause microstructure freezing, and a solidified microstructure in the vicinity of the surface was observed.

Figure 8:
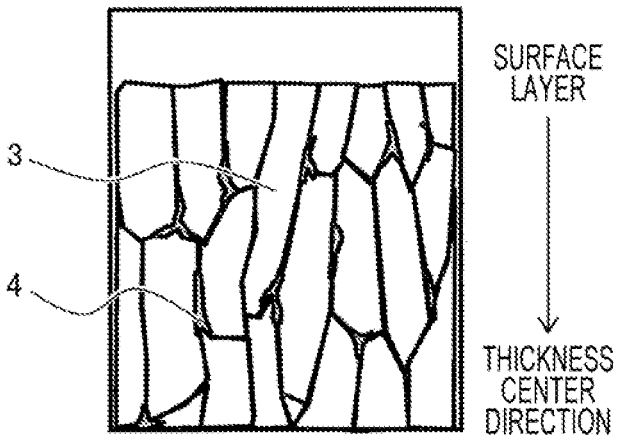
FIG. 8 schematically illustrates a solidified microstructure in the vicinity of the surface of a cast slab whose surface temperature is equal to or higher than Tp and to which a processing strain of 8.0% has not been applied.

FIG. 8 schematically illustrates a solidified microstructure in the vicinity of the surface of a cast slab whose surface temperature is equal to or higher than Tp and to which a processing strain of 8.0% is not applied. As illustrated in FIG. 8, when a processing strain was not applied to the cast slab, the coarse austenite columnar crystals 3 having a grain width of 3 to 5 mm, which are peculiar to high-manganese steel, were observed, and at grain boundaries thereof were observed the coarse carbides ($M_{23}C_6$) 4.

These results confirmed that when a cast slab is manufactured by the method for manufacturing a high-manganese steel cast slab according to this embodiment, austenite grains in a region extending from the surface of the cast slab to a depth of about 5 mm are refined, and the formation of coarse carbides is suppressed. By refining a solidified microstructure of a cast slab and suppressing the formation of coarse carbides in this manner, cracking during rolling starting from, for example, carbides precipitating at grain boundaries is suppressed, thus enabling the manufacture of a steel slab or steel sheet with suppressed surface cracking.

As described above, by applying a processing strain to a cast slab having a surface temperature in the range of 600° C. to 1100° C., grains in the surface layer of the cast slab can be refined. In the method for manufacturing a high-manganese steel cast slab according to this embodiment, a processing strain is applied in a continuous-casting machine or during transportation before subsequent charging into a heating furnace for hot rolling, and thus the amount of heat applied to the cast slab for processing strain application can be small.

While this embodiment has been described in the context of blooming, the cast slab manufactured by the method for manufacturing a high-manganese steel cast slab according to this embodiment produces the effect of preventing cracking during rolling on all types of hot rolling in the broad sense, which are metal rolling methods in which steel is heated to recrystallization temperatures or higher. Specific examples include blooming for obtaining an intermediate product serving as a material for product rolling, such as a bloom, from a cast slab, bar rolling or wire rolling in which a bloom or the like obtained by blooming is further rolled to have a smaller section, sheet hot rolling for obtaining a steel sheet in coil by continuously rolling a cast slab with multi-stand roughing mills and finishing mills called a hot strip mill, and plate rolling for obtaining a plate by performing repeated reciprocating rolling using a single-stand roughing mill and a single-stand finishing mill.

EXAMPLES

Next, Examples will be described. Molten high-manganese steel was refined using a 150-ton converter, an electrode-heating-type ladle refining furnace, and an RH vacuum degasifier in this order to adjust the components and temperature of the molten steel and then passed through a tundish with 30 ton capacity, and a cast slab with a section size of 1250 mm wide×250 mm thick was cast through a curved continuous-casting machine with a radius of curvature of 10.5 m. The casting speed was set to be in the range of 0.7 to 0.9 m/min, and the volume of secondary cooling water was set to be in the range of 0.3 to 0.6 L/kg in terms of specific water volume. A pair of reduction rolls was disposed in a horizontal part of the continuous-casting machine to apply a processing strain of 0.0% to 15.0% to the cast slab thickness of 250 mm. The cast slab after continuous casting was cut, transported out, and then made into a cold slab once by slow cooling. At this stage, some cast slabs were checked for the presence of a surface crack by liquid penetrant testing.

Thereafter, the cast slab was charged into a heating furnace and reheated, soaked at 1150° C., and then bloomed to a total rolling reduction of 48%. The steel slab obtained by blooming was checked for the presence of a surface crack by liquid penetrant testing. For the steel slab in which cracking was detected, the presence of a crack was visually observed while grinding the surface of the steel slab with a grinder in increments of 0.5 mm depth, and a grinding depth at the point where cracks were no longer observed was determined as a crack depth. Table 2 shows the chemical composition, the processing strain applying conditions, and the surface state of steel slabs obtained by blooming of Examples and Comparative Examples.

TABLE 2

| | Chemical composition (mass %) | | | | | | | | | | Formula (2) |
|---|---|---|---|---|---|---|---|---|---|---|---|
| Category | C | Si | Mn | P | S | Al | Cr | Ni | N | Ca | Tp (° C.) |
| Inventive Example 1 | 0.10 | 0.40 | 28 | 0.015 | 0.0010 | 0.010 | 7.0 | 1.00 | 0.1000 | 0.0025 | 801.5 |
| Inventive Example 2 | 0.14 | 0.40 | 30 | 0.025 | 0.0008 | 0.010 | 7.0 | 0.80 | 0.0800 | 0.0030 | 806.9 |
| Inventive Example 3 | 0.25 | 0.20 | 12 | 0.025 | 0.0060 | 0.020 | 10.0 | 0.05 | 0.0050 | 0.0020 | 1036.2 |
| Inventive Example 4 | 0.30 | 0.30 | 24 | 0.010 | 0.0050 | 0.020 | 3.0 | 0.03 | 0.0100 | 0.0020 | 725.3 |
| Inventive Example 5 | 0.48 | 0.45 | 25 | 0.025 | 0.0050 | 0.030 | 5.0 | 0.10 | 0.0100 | 0.0025 | 863.3 |
| Inventive Example 6 | 0.48 | 0.45 | 25 | 0.015 | 0.0020 | 0.030 | 5.0 | 0.10 | 0.0150 | 0.0001 | 863.3 |
| Inventive Example 7 | 0.50 | 0.50 | 25 | 0.015 | 0.0010 | 0.030 | 3.0 | 0.10 | 0.0200 | 0.0025 | 790.3 |
| Inventive Example 8 | 0.70 | 0.10 | 10 | 0.030 | 0.0050 | 0.070 | 1.0 | 0.02 | 0.0500 | 0.0025 | 840.5 |
| Inventive Example 9 | 1.00 | 0.50 | 13 | 0.020 | 0.0020 | 0.025 | 0.1 | 0.05 | 0.0150 | 0.0025 | 900.0 |
| Inventive Example 10 | 1.30 | 0.50 | 15 | 0.020 | 0.0070 | 0.030 | 0.5 | 0.01 | 0.0200 | 0.0025 | 1018.3 |
| Inventive Example 11 | 0.25 | 0.20 | 12 | 0.025 | 0.0060 | 0.020 | 10.0 | 0.05 | 0.0050 | 0.0020 | 1036.2 |
| Inventive Example 12 | 0.48 | 0.45 | 25 | 0.015 | 0.0020 | 0.030 | 5.0 | 0.10 | 0.0150 | 0.0001 | 863.3 |
| Inventive Example 13 | 0.48 | 0.45 | 25 | 0.025 | 0.0050 | 0.030 | 5.0 | 0.10 | 0.0100 | 0.0005 | 863.3 |
| Inventive Example 14 | 0.48 | 0.45 | 25 | 0.025 | 0.0070 | 0.030 | 5.0 | 0.10 | 0.0100 | 0.0001 | 863.3 |
| Comparative Example 1 | 0.48 | 0.45 | 25 | 0.025 | 0.0070 | 0.030 | 5.0 | 0.10 | 0.0100 | 0.0001 | 863.3 |
| Comparative Example 2 | 1.30 | 0.50 | 15 | 0.020 | 0.0100 | 0.030 | 0.5 | 0.01 | 0.0200 | 0.0025 | 1018.3 |
| Comparative Example 3 | 0.48 | 0.45 | 25 | 0.025 | 0.0070 | 0.030 | 5.0 | 0.10 | 0.0100 | 0.0001 | 863.3 |
| Comparative Example 4 | 1.30 | 0.50 | 15 | 0.020 | 0.0100 | 0.030 | 0.5 | 0.01 | 0.0200 | 0.0025 | 1018.3 |
| Comparative Example 5 | 0.10 | 0.40 | 28 | 0.015 | 0.0010 | 0.010 | 7.0 | 1.00 | 0.1000 | 0.0025 | 801.5 |
| Comparative Example 6 | 0.14 | 0.40 | 30 | 0.025 | 0.0008 | 0.010 | 7.0 | 0.80 | 0.0800 | 0.0030 | 806.9 |
| Comparative Example 7 | 0.25 | 0.20 | 12 | 0.025 | 0.0060 | 0.020 | 10.0 | 0.05 | 0.0050 | 0.0020 | 1036.2 |
| Comparative Example 8 | 0.30 | 0.30 | 24 | 0.010 | 0.0050 | 0.020 | 3.0 | 0.03 | 0.0100 | 0.0020 | 725.3 |
| Comparative Example 9 | 0.48 | 0.45 | 25 | 0.025 | 0.0050 | 0.030 | 5.0 | 0.10 | 0.0100 | 0.0025 | 863.3 |
| Comparative Example 10 | 0.48 | 0.45 | 25 | 0.015 | 0.0020 | 0.030 | 5.0 | 0.10 | 0.0150 | 0.0001 | 863.3 |
| Comparative Example 11 | 0.50 | 0.50 | 25 | 0.015 | 0.0010 | 0.030 | 3.0 | 0.10 | 0.0200 | 0.0025 | 790.3 |
| Comparative Example 12 | 0.70 | 0.10 | 10 | 0.030 | 0.0050 | 0.070 | 1.0 | 0.02 | 0.0500 | 0.0025 | 840.5 |
| Comparative Example 13 | 1.00 | 0.50 | 13 | 0.020 | 0.0020 | 0.025 | 0.1 | 0.05 | 0.0150 | 0.0025 | 900.0 |

TABLE 2-continued

| | | | | | | | | | | | |
|---|---|---|---|---|---|---|---|---|---|---|---|
| Comparative Example 14 | 1.30 | 0.50 | 15 | 0.020 | 0.0080 | 0.030 | 0.5 | 0.01 | 0.0200 | 0.0025 | 1018.3 |
| Comparative Example 15 | 0.14 | 0.40 | 30 | 0.025 | 0.0008 | 0.010 | 7.0 | 0.80 | 0.0800 | 0.0030 | 806.9 |
| Comparative Example 16 | 0.48 | 0.45 | 25 | 0.015 | 0.0020 | 0.030 | 5.0 | 0.10 | 0.0150 | 0.0001 | 863.3 |
| Comparative Example 17 | 0.48 | 0.45 | 25 | 0.015 | 0.0020 | 0.030 | 5.0 | 0.10 | 0.0150 | 0.0001 | 863.3 |
| Comparative Example 18 | 0.10 | 0.40 | 28 | 0.015 | 0.0010 | 0.010 | 7.0 | 1.00 | 0.1000 | 0.0025 | 801.5 |
| Comparative Example 19 | 0.14 | 0.40 | 30 | 0.025 | 0.0008 | 0.010 | 7.0 | 0.80 | 0.0800 | 0.0030 | 806.9 |
| Comparative Example 20 | 0.48 | 0.45 | 25 | 0.015 | 0.0020 | 0.030 | 5.0 | 0.10 | 0.0150 | 0.0001 | 863.3 |
| Comparative Example 21 | 0.48 | 0.45 | 25 | 0.015 | 0.0020 | 0.030 | 5.0 | 0.10 | 0.0150 | 0.0001 | 863.3 |

| Category | Formula (3) Mn × (S − 0.8 × Ca) | Cast slab surface temperature (° C.) at strain application | Formula (1) Processing strain amount (%) | Presence of surface crack after rolling | Number of cracks (number/m) | Crack depth (mm) |
|---|---|---|---|---|---|---|
| Inventive Example 1 | −0.03 | 900 | 3.0 | absent | 0.0 | 0.0 |
| Inventive Example 2 | −0.05 | 900 | 4.0 | absent | 0.0 | 0.0 |
| Inventive Example 3 | 0.05 | 1050 | 4.0 | absent | 0.0 | 0.0 |
| Inventive Example 4 | 0.08 | 900 | 5.0 | absent | 0.0 | 0.0 |
| Inventive Example 5 | 0.08 | 900 | 8.0 | absent | 0.0 | 0.0 |
| Inventive Example 6 | 0.05 | 900 | 5.0 | absent | 0.0 | 0.0 |
| Inventive Example 7 | −0.03 | 900 | 10.0 | absent | 0.0 | 0.0 |
| Inventive Example 8 | 0.03 | 900 | 5.0 | absent | 0.0 | 0.0 |
| Inventive Example 9 | 0 | 1050 | 5.0 | absent | 0.0 | 0.0 |
| Inventive Example 10 | 0.08 | 1050 | 8.0 | absent | 0.0 | 0.0 |
| Inventive Example 11 | 0.05 | 950 | 4.0 | present | 1.5 | 1.5 |
| Inventive Example 12 | 0.05 | 800 | 5.0 | present | 1.0 | 0.5 |
| Inventive Example 13 | 0.12 | 800 | 8.0 | present | 2.5 | 1.5 |
| Inventive Example 14 | 0.17 | 900 | 8.0 | present | 2.0 | 1.5 |
| Comparative Example 1 | 0.17 | 800 | 0.0 | present | 10.0 | 4.0 |
| Comparative Example 2 | 0.12 | 1000 | 0.0 | present | 12.0 | 6.0 |
| Comparative Example 3 | 0.17 | 900 | 2.5 | present | 8.0 | 3.5 |
| Comparative Example 4 | 0.12 | 1050 | 13.0 | present | 7.5 | 4.5 |
| Comparative Example 5 | −0.03 | 900 | 0.0 | present | 4.5 | 3.0 |
| Comparative Example 6 | −0.05 | 900 | 0.0 | present | 8.8 | 5.0 |
| Comparative Example 7 | 0.05 | 1050 | 0.0 | present | 7.5 | 4.0 |
| Comparative Example 8 | 0.08 | 900 | 0.0 | present | 15.6 | 8.0 |
| Comparative Example 9 | 0.08 | 900 | 0.0 | present | 7.5 | 4.0 |
| Comparative Example 10 | 0.05 | 900 | 0.0 | present | 4.1 | 3.0 |
| Comparative Example 11 | −0.03 | 900 | 0.0 | present | 6.4 | 2.5 |
| Comparative Example 12 | 0.03 | 900 | 0.0 | present | 7.8 | 3.5 |
| Comparative Example 13 | 0 | 1050 | 0.0 | present | 12.2 | 5.0 |
| Comparative Example 14 | 0.09 | 1050 | 0.0 | present | 14.8 | 4.5 |
| Comparative Example 15 | −0.05 | 900 | 2.8 | present | 3.8 | 2.5 |
| Comparative Example 16 | 0.05 | 900 | 1.0 | present | 4.8 | 3.0 |
| Comparative Example 17 | 0.05 | 900 | 12.0 | present | 4.2 | 3.0 |
| Comparative Example 18 | −0.03 | 900 | 0.0 | present | 4.5 | 3.0 |
| Comparative Example 19 | −0.05 | 900 | 2.8 | present | 3.8 | 2.5 |
| Comparative Example 20 | 0.05 | 900 | 1.0 | present | 15.6 | 8.0 |
| Comparative Example 21 | 0.05 | 900 | 12.0 | present | 4.2 | 3.0 |

As shown in Table 2, for the steel slabs of Comparative Examples 1 to 21 each manufactured from a cast slab to which a processing strain of 3.0% or more and 10.0% or less was not applied, the number of cracks (the number of cracks per unit length in the length direction of the cast slab) was 4.2 to 15.6 per meter, and the crack depth was 2.5 to 8.0 mm. In contrast, for the steel slabs of Inventive Examples 1 to 14 each manufactured from a cast slab to which a processing strain of 3.0% or more and 10.0% or less was applied, the number of cracks was 0.0 to 2.5 per meter, and the crack depth was 0.0 to 1.5 mm. These results confirmed that applying a processing strain of 3.0% or more and 10.0% or less to a cast slab can suppress surface cracking of a steel slab obtained by rolling.

Among Inventive Examples 1 to 14, for the steel slab of Inventive Example 13 manufactured from a cast slab to which a processing strain was applied, the cast slab having a surface temperature of lower than Tp calculated by formula (2) and not satisfying formula (3), the number of cracks was 2.5 per meter, and the crack depth was 1.5 mm, whereas for the steel slab of Inventive Example 14 manufactured from a cast slab to which a processing strain was applied, the cast slab having a surface temperature equal to or higher than Tp, the number of cracks was 2.0 per meter, and the crack depth was 1.5 mm. These results confirmed that applying a processing strain of 3.0% or more and 10.0% or less to a cast slab whose surface temperature is equal to or higher than Tp can further suppress surface cracking of a steel slab obtained by rolling.

Among Inventive Examples 1 to 14, for the steel slab of Inventive Example 13 manufactured from a cast slab to which a processing strain was applied, the cast slab having a surface temperature of lower than Tp calculated by formula (2) and not satisfying formula (3), the number of cracks was 2.5 per meter, and the crack depth was 1.5 mm, whereas for the steel slabs of Inventive Examples 11 and 12 satisfying formula (3), the number of cracks was 0.5 to 1.5 per meter, and the crack depth was 0.5 to 1.5 mm. These results confirmed that applying a processing strain of 3.0% or more and 10.0% or less to a cast slab satisfying formula (3) can further suppress surface cracking of a steel slab obtained by rolling.

Furthermore, among Inventive Examples 1 to 14, for the steel slabs of Inventive Examples 1 to 10 each manufactured from a cast slab to which a processing strain of 3.0% or more and 10.0% or less was applied, the cast slab satisfying formula (3) and having a surface temperature equal to or higher than Tp calculated by formula (2), the number of cracks was 0.0 per meter, and the crack depth was 0.0 mm. These results confirmed that applying a processing strain of 3.0% or more and 10.0% or less to a cast slab satisfying formula (3) and having a surface temperature equal to or higher than Tp can greatly suppress surface cracking of a steel slab obtained by rolling.

In the above Examples, the manufacturing process from making a cast slab once into a cold slab to blooming the slab by reheating was described. After this, finish rolling using a steel slab obtained by blooming as a material can be performed to manufacture a steel sheet with suppressed surface cracking.

As described above, it was confirmed that by using a cast slab manufactured by the method for manufacturing a cast slab according to this embodiment, surface cracking during hot rolling is suppressed, and a high-manganese steel cast slab or steel sheet with suppressed surface cracking can be manufactured.

From these results, it was confirmed that by using the method for manufacturing a cast slab according to this embodiment, a high-manganese steel cast slab that can suppress cracking during rolling even when a high-manganese steel slab or steel sheet having a Mn content of more than 20 mass % is manufactured can be manufactured. It was also confirmed that this can achieve a reduction in repair cost, a reduction in manufacturing lead time, and an improvement in yield in manufacturing a high-manganese steel slab or steel sheet.

REFERENCE SIGNS LIST

1 fine austenite grain
2 fine carbide ($M_{23}C_6$)
3 coarse austenite columnar crystal
4 coarse carbide ($M_{23}C_6$)

The invention claimed is:

1. A method for manufacturing a high-manganese steel cast slab, comprising manufacturing a cast slab by continuously casting a molten steel having a chemical composition containing, by mass %, C: 0.10% or more and 1.3% or less,
Si: 0.10% or more and 0.90% or less,
Mn: 10% or more and 30% or less,
P: 0.030% or less,
S: 0.0070% or less,
Al: 0.01% or more and 0.07% or less,
Cr: 0.1% or more and 10% or less,
Ni: 0.01% or more and 1.0% or less,
Ca: 0.0001% or more and 0.010% or less, and
N: 0.0050% or more and 0.2000% or less,
and further containing, as optional additive elements, Mg: 0.0001% or more and 0.010% or less and REM: 0.0001% or more and 0.010% or less,
with the balance being iron and unavoidable impurities,
wherein in a continuous-casting machine or during transportation before subsequent charging into a heating furnace for hot rolling, a processing strain is applied to the cast slab having a surface temperature of 600° C. or higher and 1100° C. or lower in such an amount that a processing strain amount calculated by formula (1) is 3.0% or more and 10.0% or less:

$$\text{Processing strain amount (\%)} = \ln(\text{sectional area of cast slab before processing}/\text{sectional area of cast slab after processing}) \times 100. \quad (1)$$

2. The method for manufacturing a high-manganese steel cast slab according to claim 1, wherein the processing strain is applied to the cast slab having a surface temperature equal to or higher than Tp calculated by formula (2):

$$Tp(^\circ\ \text{C.}) = 600 + 15[\%\ \text{C}]^2 + 333[\%\ \text{C}] - 4[\%\ \text{Mn}] + 40[\%\ \text{Cr}] \quad (2)$$

where, in formula (2), [% C], [% Mn], and [% Cr] are contents (mass %) of C, Mn, and Cr, respectively, in the cast slab.

3. The method for manufacturing a high-manganese steel cast slab according to claim 1, wherein the chemical composition of the cast slab further satisfies formula (3):

$$[\%\ \text{Mn}] \times ([\%\ \text{S}] - 0.8 \times [\%\ \text{Ca}]) \leq 0.10 \quad (3)$$

where, in formula (3), [% Mn], [% S], and [% Ca] are contents (mass %) of Mn, S, and Ca, respectively, in the cast slab.

4. A method for manufacturing a high-manganese steel slab or steel sheet, comprising hot rolling a cast slab manufactured by the method for manufacturing a high-manganese steel cast slab according to claim 1.

* * * * *